US006015274A

United States Patent [19]

Bias et al.

[11] Patent Number: 6,015,274

[45] Date of Patent: Jan. 18, 2000

[54] LOW PROFILE CEILING FAN HAVING A REMOTE CONTROL RECEIVER

[75] Inventors: Larry S. Bias, Bartlett; Robert E. Ferguson, Memphis, both of Tenn.

[73] Assignee: Hunter Fan Company, Memphis, Tenn.

[21] Appl. No.: 08/957,194

[22] Filed: Oct. 24, 1997

[51] Int. Cl.[7] ..... F04B 35/04

[52] U.S. Cl. ..... 417/423.1; 417/423.14

[58] Field of Search ..... 417/44.1, 423.12, 417/423.14, 424.1, 423.1, 423.7

[56] References Cited

U.S. PATENT DOCUMENTS

| | | | |
|---|---|---|---|
| 4,186,433 | 1/1980 | Baldwin | 362/263 |
| 4,221,281 | 9/1980 | Melson | 191/12 R |
| 4,449,168 | 5/1984 | Ewing | 362/404 |
| 4,538,973 | 9/1985 | Angott et al. | 417/572 |
| 4,548,554 | 10/1985 | Angott | 417/572 |
| 4,621,992 | 11/1986 | Angott | 417/572 |
| 4,719,446 | 1/1988 | Hart | 340/310 A |
| 4,768,926 | 9/1988 | Gilbert, Jr. | 416/61 |
| 5,033,113 | 7/1991 | Wang | 455/603 |
| 5,041,825 | 8/1991 | Hart et al. | 340/825.06 |
| 5,187,472 | 2/1993 | Hart et al. | 340/825.69 |
| 5,189,412 | 2/1993 | Mehta et al. | 340/825.69 |
| 5,222,864 | 6/1993 | Pearce | 416/5 |
| 5,242,269 | 9/1993 | Chang | 416/244 |
| 5,304,037 | 4/1994 | Scofield | 416/134 R |
| 5,340,277 | 8/1994 | Whitaker | 416/5 |
| 5,528,229 | 6/1996 | Mehta | 340/825.06 |
| 5,541,584 | 7/1996 | Mehta et al. | 340/825.57 |
| 5,627,527 | 5/1997 | Mehta | 340/825.06 |
| 5,689,261 | 11/1997 | Mehta et al. | 341/173 |
| 5,738,496 | 4/1998 | Mehta | 417/44.1 |

OTHER PUBLICATIONS

Spotts, M.F. "Design of Machine Elements" Prentice Hall, Jan. 1985, p. 241.

*Primary Examiner*—Charles G. Freay
*Attorney, Agent, or Firm*—Garrison, Morris & Haight, PLLC

[57] ABSTRACT

A remote control receiver is provided, as well as a system for installing the receiver within a motor housing of a ceiling fan which may comprise a low profile ceiling fan. The receiver may be provided as an add-on unit or pre-packaged with new fans. The receiver includes upper and lower housings which engage one another and define an interior space of the receiver. Electronic circuitry is provided within the interior space which is effective for controlling at least the rotational speed of the ceiling fan motor and the fan blades attached to the motor. The receiver may optionally control the operation of a light fixture included as part of the fan, and in some applications the receiver may also control the direction of rotation of the motor and blades. The system for installing the receiver within the motor housing includes a stationary portion of the ceiling fan, such as a ceiling mount plate or motor mount plate, which is spaced apart from the rotating components. The system may farther include a plurality of apertures formed in the lower housing of the receiver and at least one strap, wire or cable, etc. which is passed through selected ones of the apertures and attaches the receiver to the stationary portion of the fan. Alternatively, the receiver may be disposed within a mount pocket formed by a bracket attached to a stationary portion of the fan such as the ceiling mount plate.

24 Claims, 7 Drawing Sheets

LOW PROFILE CEILING FAN HAVING A REMOTE CONTROL RECEIVER

BACKGROUND OF THE INVENTION 1.0 Field of the Invention

The present invention relates generally to ceiling fans and more specifically to low profile ceiling fans incorporating a remote control receiver within the motor housing of the ceiling fan.

2.0 Related Art

Ceiling fans have become an increasingly popular supplementary means of conditioning air within both commercial and residential buildings. The growing popularity of ceiling fans has resulted in a wide variety of improvements to these products, affecting performance, appearance and ease of operation. A recent advance in ceiling fan technology is the incorporation of a remote control unit, comprising a hand-held or wall-mounted transmitter and a receiver which permits the user to remotely control the fan speed and may also permit remote control of any light fixture which may be included or added as part of the ceiling fan.

Prior to the present invention, the remote control feature has been available with "standard arrangement" ceiling fans (i.e., those which include a canopy and downrod arrangement) but has not been available with conventional "low profile" ceiling fans which may also be referred to as "hugger" ceiling fans in the industry. Low profile or hugger ceiling fans do not include a canopy and downrod arrangement but may otherwise be the same as standard arrangement ceiling fans. Both types of fans include a plurality of fan blades mounted on and rotatably driven by a motor, typically an inside-out motor. Ceiling fans commonly use inside-out motors since the rotating portion, or rotor, of the motor is disposed in surrounding relationship with the stator which facilitates mounting the fan blades on the rotor. Both types of ceiling fans also include a decorative motor housing which at least partially surrounds the motor. The fan blades must be positioned at a certain distance from the floor to achieve proper air circulation. This may be accomplished in rooms having relatively high or vaulted ceilings by using standard arrangement ceiling fans in which the fan is suspended from the ceiling by a canopy and downrod arrangement. However, for relatively lower ceilings, a downrod may position the fan blades too close to the floor. In this event a low profile ceiling fan may be used in which the canopy and downrod are omitted and the motor housing is substantially flush with the ceiling to provide proper spacing of the fan blades above the floor.

Both the transmitter and receiver of a remotely-controlled standard arrangement fan are typically add-on accessories that are purchased separately from the ceiling fan. Alternately, the remote control may be pre-packaged with the ceiling fan. In either case, the receiver is wired into the circuitry of the fan and adjusts the fan speed or lights according to the signals received from the hand-held transmitter.

Add-on or pre-packaged remote control receivers are typically installed in the canopy of standard arrangement fans since this location provides ample room and there are no moving parts within the canopy which could damage the receiver. Alternate locations include the switch housing, or a nearby wall. However, switch housings are not a practical location since they barely have enough space to accommodate the existing circuitry. Further, the potential wiring problems associated with a wall-mounted receiver make this location an unattractive choice.

In addition to the foregoing problems associated with incorporating a remote control receiver in a standard arrangement ceiling fan, low profile ceiling fans do not include a canopy making the potential incorporation of a remote control receiver even more difficult. Due to these problems, the inventor is unaware of any conventional low profile ceiling fans which incorporate a remote control receiver for the advantageous use by the consumer.

SUMMARY

In view of the foregoing needs, the present invention is directed to a remote control receiver and to a system for installing the remote control receiver in a ceiling fan, which may comprise a low profile ceiling fan. The remote control receiver and system for installing the receiver of the present invention permits the user to enjoy remote control operation of a low profile ceiling fan which was heretofore unavailable.

The remote control receiver includes an upper housing and a lower housing which engage one another and define an interior space containing electronic circuitry which is effective for controlling at least the rotational speed of the rotating portion, or rotor of the ceiling fan motor and of the fan blades attached to the motor. The remote control receiver may optionally control the direction of rotation of the rotor and fan blades as well as the operation of any light source which may be included as part of the fan. The remote control receiver receives radio frequency signals, in response to input by the operator, to control the foregoing functional operations of the ceiling fan. The transmitter may either be hand-held or wall-mounted.

The lower housing of the remote control receiver includes a lower portion, opposing end portions which extend upwardly from the lower portion and opposing side portions which extend upwardly from the lower portion and interconnect the side portions. The receiver further includes a first plurality of apertures formed in and extending through the lower portion of the lower housing, and second and third pluralities of apertures. Each of the second plurality of apertures is formed in and extends through one of the opposing end portions and is disposed proximate one of the first plurality of apertures. Each of the third plurality of apertures is formed in and extends through one of the opposing side portions of the lower housing and is disposed proximate one of the first plurality of apertures. This alignment among the first, second, and third pluralities of apertures facilitates installing the receiver in the ceiling fan according to a particularly preferred embodiment of the installation system, as subsequently discussed in greater detail.

According to a particularly preferred embodiment, the remote control receiver is incorporated in a low profile ceiling fan which is attached to a ceiling by a ceiling mount plate. The low profile ceiling fan includes a motor, having a rotor and a stator. The motor may be an inside-out motor, with the rotor being rotatable about the stator. However, the remote controller receiver of the present invention may also be incorporated in a low profile ceiling fan having other types of motors, such as those in which the rotor is rotatable within the surrounding stator. The fan further includes a plurality of fan blades attached to the rotor and a motor housing disposed in surrounding relationship with the motor, so as to define an interior space. In one embodiment, the motor is supported directly by the ceiling mount plate, with an upper end of a stator shaft attached to the ceiling mount plate. In another embodiment, the low profile ceiling fan includes a motor mount plate, attached to an upper end of the stator shaft, with the motor mount plate being suspended from the ceiling mount plate.

The remote control receiver is disposed within the interior space defined by the motor housing and secured to a stationary portion of the ceiling fan at a location spaced apart from the rotating portion, or rotor of the motor so as to avoid damage to the remote control receiver. According to a particularly preferred embodiment, the system for installing the remote control receiver includes the previously discussed first, second and third plurality of apertures formed in the lower housing of the receiver and at least one strap which is passed through selected ones of the apertures forming a loop to secure the receiver to either the ceiling mount plate or the motor mount plate. Cables, wires or equivalent means may be used in lieu of the strap, and the receiver may alternatively be secured to other stationary portions of the fan at a location spaced apart from the rotor within the motor housing. The previously discussed alignment among the first and second plurality of apertures, as well as among the first and third plurality of apertures, facilitates the foregoing means for installing the remote control receiver. Alternatively, the ceiling fan may include a bracket attached to a stationary portion of the ceiling fan, such as the ceiling mount plate, with the bracket and ceiling mount plate forming a mount pocket which is effective for receiving the remote control receiver. The remote control receiver may be disposed within the mount pocket and rest on the bottom portion of the bracket. Also, other means, such as magnets, Velcro or adhesive, may be used in lieu of the apertures and straps or cables, etc., to secure the remote control receiver to a stationary portion of the ceiling fan in a simple, economic manner.

BRIEF DESCRIPTION OF THE DRAWINGS

These and other features, aspects, and advantages of the present invention will become better understood with regard to the following description, appended claims and accompanying drawings, wherein:

DETAILED DESCRIPTION

Figure 1:
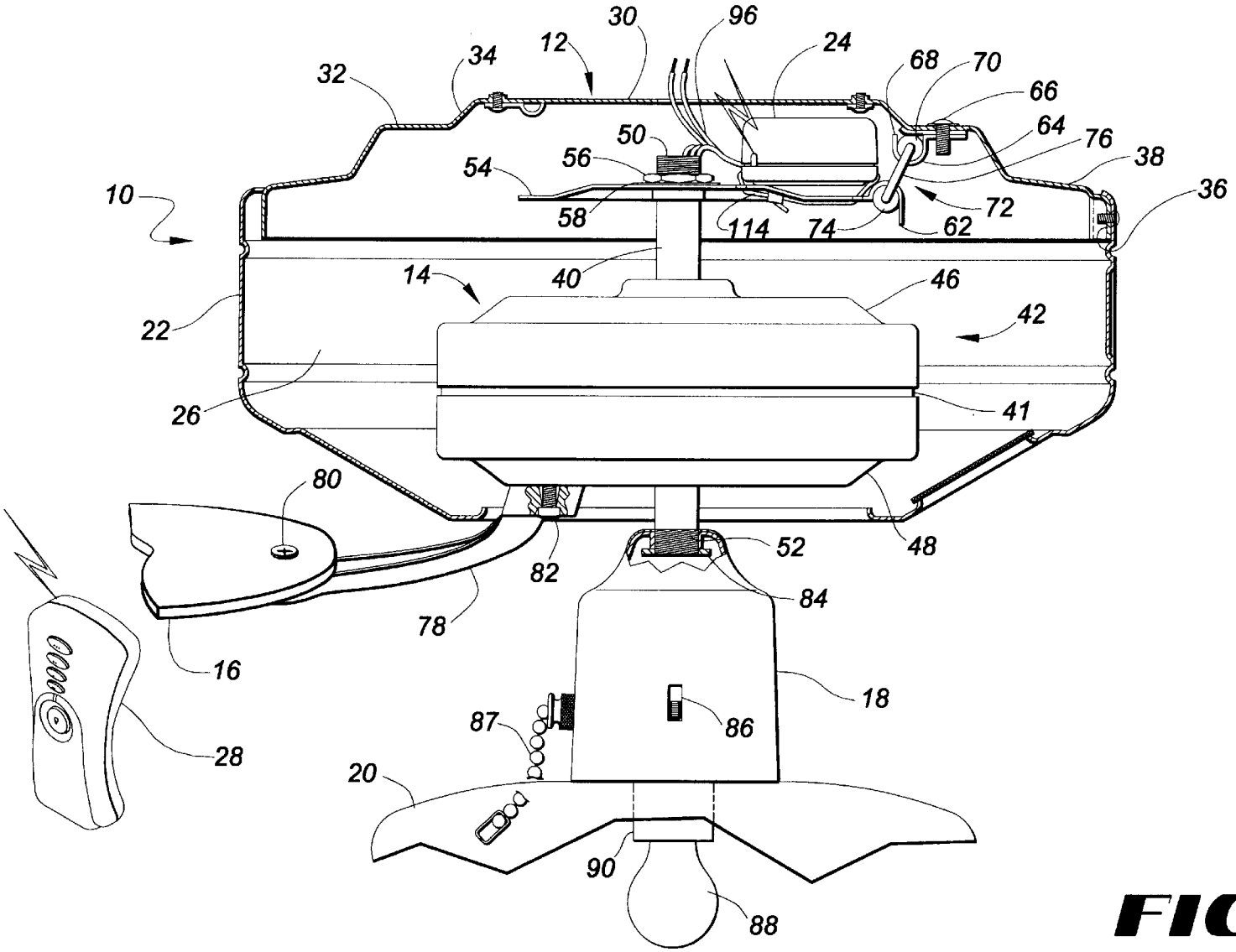
FIG. 1 is a cross-sectional view illustrating a low profile ceiling fan according to a first embodiment of the present invention.

FIG. 1 is cross-sectional view illustrating a low profile ceiling fan 10 according to the present invention. As used herein, the term "low profile ceiling fan" refers to a ceiling fan which may be substantially flush-mounted to a ceiling so the fan blades have the proper vertical clearance above the floor. Low profile ceiling fans, such as fan 10, do not include a canopy and vertically extending downrod attached to the canopy which are included in "standard arrangement" ceiling fans (discussed previously in the Background) to position the fan at the desired height of operation. Although low profile ceiling fans are generally known in the art, the inventors are unaware of any low profile ceiling fan incorporating a remote control receiver for the purpose of controlling selected functions of the ceiling fan. While the principles of the present invention are illustrated in conjunction with two specific embodiments of a low profile ceiling fan, it should be understood that an important feature of the present invention, i.e., the incorporation of a remote control receiver, may be utilized in conjunction with a wide variety of low profile ceiling fans.

Low profile ceiling fan 10 includes a ceiling mount plate 12 which may be attached to the ceiling (not shown) of a room, an "inside-out" motor 14 supported by plate 12, and a plurality of fan blades 16 (portion of one shown) mounted to a rotatable portion of motor 14. A switch housing 18 is attached to a lower, stationary member of motor 14. An optional light fixture 20 is mounted on the switch housing 18. A motor housing 22, which may include a decorative outer surface finish, is attached to mount plate 12 in surrounding relationship with motor 14, so as to substantially enclose motor 14 and obscure motor 14 from view. Ceiling fan 10 further includes a remote control receiver 24 which is disposed within an interior space 26 defined by the motor housing 22. The receiver 24 is secured to a stationary portion of ceiling fan 10 at a position spaced apart from the rotating components of motor 14 to avoid distress to receiver 24. Receiver 24 receives radio frequency signals from a remote control transmitter 28 to control the speed of rotation of motor 14 and the operation of the optional light fixture 20, if installed.

The mount plate 12 includes a substantially flat, disk-shaped, upper central portion 30 which is disposed proximate the room ceiling. Plate 12 is attached to the ceiling by conventional means such as a plurality of fasteners which extend through holes formed in the upper central portion 30 of plate 12. Plate 12 further includes an annular shoulder portion 32, connected to the upper central portion 30 via a tapered transition portion 34, and an outer, downwardly-extending annular flange 36 which is connected to shoulder portion 32 via a transition portion 38. The motor housing 22 is attached to flange 36 as subsequently described.

The motor 14 is formed from separate "inside-out" a.c. motor components that are interconnected in a generally conventional manner. The motor 14 includes a centrally disposed stator (not shown) fixedly mounted on a stationary stator shaft 40. The stator, as is well known, is typically formed from a stack of electrical steel laminations and includes the windings of motor 14. An annular rotor 42 having an inner cylindrically-shaped wall (not shown) is concentrically disposed about the stator. As is known in the art, the central portion 41 of the rotor 42 is formed from a stack of electrical steel laminations.

The rotor 42 further includes upper 46 and lower 48 end covers that are affixed to the central portion 41 by any suitable means. For instance, end covers 46 and 48 may be attached with screws (not shown) which engage a plurality of vertically extending pegs (not shown) included on the central portion 41. The upper portion of upper end cover 46 and the lower portion of lower end cover 48 each include a centrally located hole (not shown) for receiving the stator shaft 40 which extends above the upper end cover 46 and below the lower end cover 48 as shown in FIG. 1. During operation of motor 14, rotor 42 rotates about the stator and the stator shaft 40.

Stator shaft 40 includes a threaded upper end 50 and a threaded lower end 52. A motor mount plate 54 is threaded onto the upper end 50 of shaft 40 and secured in place by conventional means such as a nut 56 and a lockwasher 58. The motor mount plate 54 includes a generally circular, disk-shaped portion 60 and a plurality of circumferentially spaced, hook-shaped tabs 62 which extend radially outwardly from the disk-shaped portion 60, and are effective for suspending the motor mount plate 54 from the ceiling mount plate 12 of ceiling fan 10. In the illustrative embodiment, mount plate 54 includes three equally spaced tabs 62, but other numbers of tabs 62 may be used. A plurality of mount brackets 64, equal in number to the tabs 62 of plate 54, are attached to an inner surface of annular shoulder portion 32 of mount plate 12 by conventional means such as fasteners 66. Each bracket 64 includes an upwardly facing, U-shaped portion 68 which receives an upper, substantially cylindrical bushing 70 of a hanger 72. Each hanger 72 further includes a lower, substantially cylindrical bushing 74 interconnected with upper bushing 70 via an open wire frame 76 which engages each end of bushings 70 and 74. Bushings 70 and 74 are preferably made from a soft resilient material, such as rubber. Each of the tabs 62 of motor mount plate 54 is inserted through the open frame 76 of the corresponding hanger 72 and rests on one of the lower bushings 74. In this manner, the weight of motor 14, fan blades 16, switch housing 18 and the optional light fixture 20 is supported by the ceiling mount plate 12.

Blades 16 may comprise substantially planar sections of wood or other suitable material and are mounted on motor 14 via blade irons 78. Each blade iron 78 is attached at one end to one of the blades 16 by conventional means such as fastener 80 and is attached at the other end to a lower portion of lower end cover 48 by conventional means such as fastener 82. During operation of motor 14, fan blades 16 rotate with the rotor 42 about the stator and stator shaft 40.

Switch housing 18 is threaded onto the threaded lower end 52 of stator shaft 40 and retained in place by a locking nut 84 disposed within housing 18. Switch housing 18 includes a fan direction switch 86 which is electrically connected to the windings of motor 14, and is effective for controlling the direction of rotation of rotor 42, and fan blades 16. The speed of rotation of rotor 42, and consequently the speed of rotation of fan blades 16, is controlled by the remote control receiver 24, which is hardwired to the corresponding electrical circuitry which extends upward from motor 14 through a hollow interior of the stator shaft 40 and outward through the upper threaded end 50 of shaft 40, as shown in FIG. 1. In certain applications, the direction of rotation of rotor 42 and fan blades 16 may also be controlled by receiver 24. In this instance it is necessary to install an additional relay (not shown) in the receiver 24 and route additional wiring upward through shaft 40, with the wiring connected on one end to the windings of motor 14 and on the other end to receiver 24. Receiver 24 receives radio frequency signals from transmitter 28, in response to input from the operator, to control the speed of rotation of rotor 42 and fan blades 16, and to control the direction of rotation of rotor 42 and fan blades 16 in certain applications. Although, remote control receiver 24 may be incorporated in a new low profile ceiling fan, it is envisioned that the incorporation of receiver 24 may have particular application as an add-on feature for converting a non-remote control ceiling fan to one offering remote control of the functions as described herein. Accordingly, ceiling fan 10 may include a pull chain switch 87, previously used to control the motor and fan blade speeds prior to the incorporation of receiver 24. In this event switch 87 should be selected to "high" speed to render the receiver 24 effective for controlling the speed of rotation of the rotor 42 and fan blades 16.

Light fixture 20 includes a light source 88 operatively engaged in a light bulb socket 90 which is supported by the switch housing 18. The a.c. wiring necessary to operate the light source 88 is routed through switch housing 18, upward through the hollow interior of the stator shaft 40, and outward through the upper threaded end 50 of shaft 40. The wiring is then electrically connected to receiver 24 which receives radio frequency signals from transmitter 28, in response to input from the operator, to control the operation of the light source 88. In an "add-on" application, ceiling fan 10 may include a light switch (not shown), previously used to control the operation of the light source 88 prior to the incorporation of receiver 24. In this event, the light switch should be positioned to "on", in addition to selecting switch 87 to "high", to render receiver 24 effective for controlling the operation of the light source 88.

Figure 2:
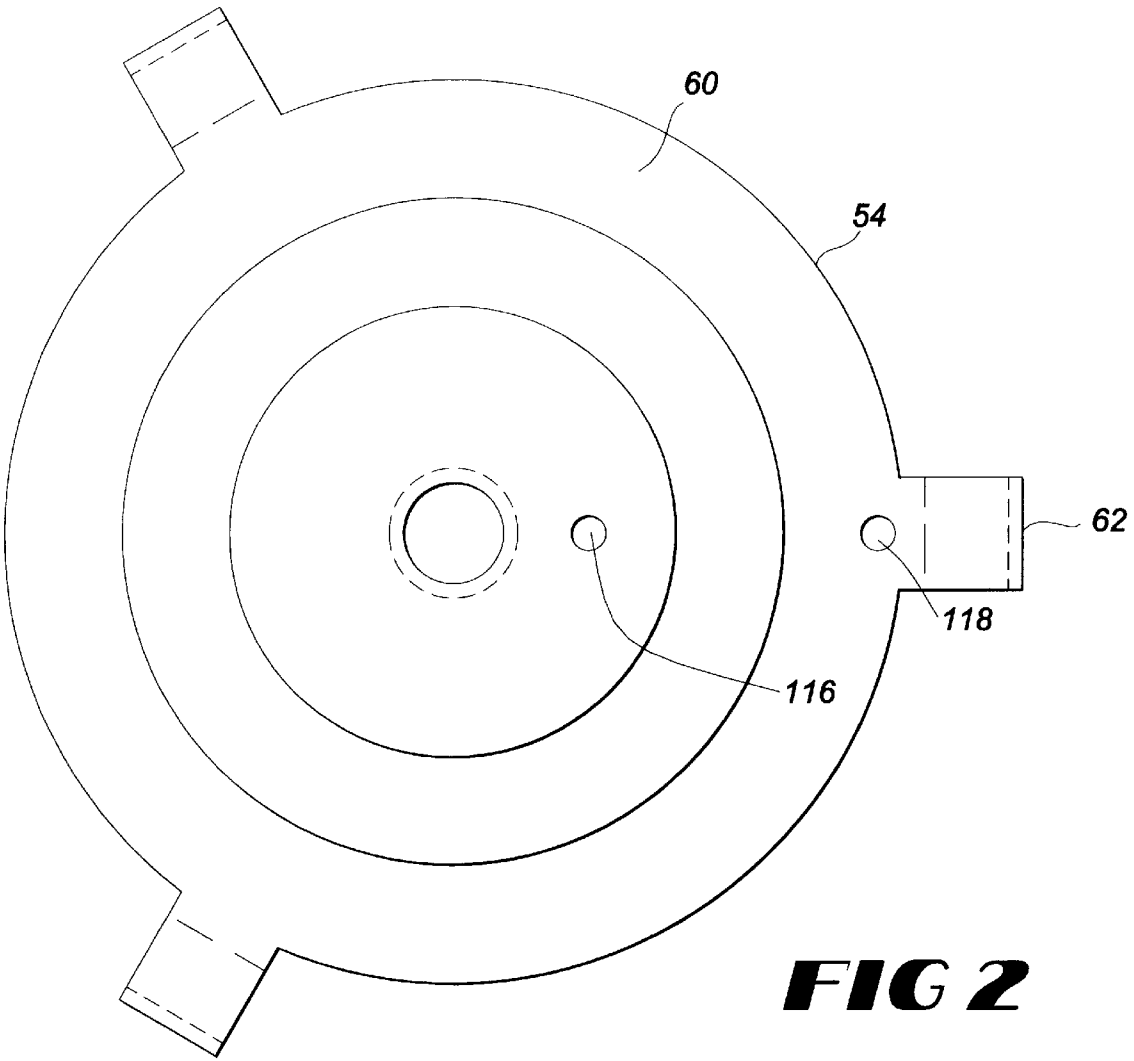
FIG. 2 is a plan view further illustrating the motor mount plate shown in FIG. 1.

The interior space 26 defined by motor housing 22 provides ample space to contain receiver 24. However, to avoid damage to receiver 24 during operation of the inside-out motor 14, the remote control receiver 24 must be secured to a stationary portion of ceiling fan 10 at a position within motor housing 22 which is spaced apart from the rotating portions of motor 14, i.e. spaced apart from the rotor 42. In the illustrative ceiling fan embodiment shown in FIGS. 1 and 2, the remote control receiver 24 is mounted to the stationary motor mount plate 54 which is spaced apart from the ceiling mount plate 12 by a distance sufficient to allow space for a receiver 24 when motor mount plate 54 is suspended from the ceiling mount plate 12. The manner in which this mounting is accomplished may be better understood with additional reference to FIGS. 3–5 which are side elevation, bottom plan, and end elevation views, respectively of the remote control receiver 24, and to the enlarged cross-sectional view shown in FIG. 6.

Receiver 24 includes an upper housing 92 and a lower housing 94. In the illustrative embodiment housings 92 and 94 engage one another in a snap fit, i.e. the lower housing 94 includes tabs or protrusions which may engage corresponding, aligned detents formed in the upper housing 92. Housings 92 and 94 together form an interior space which contains the generally conventional electronic circuitry, required for controlling the speed of rotation of rotor 42 and fan blades 16, as well as the operation of light fixture 20. The circuitry terminates in a plurality of wires 96 which exit the upper housing 92 through an opening 98 formed therein. Receiver 24 also includes an antenna 100 which is effective for receiving the radio frequency signals from the remote control transmitter 28.

Figure 5:
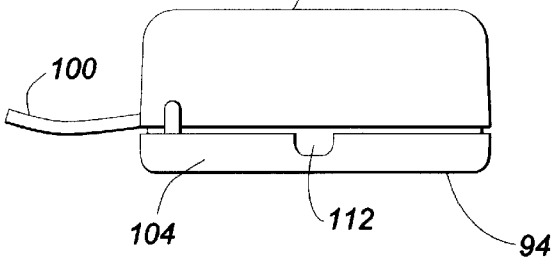
FIG. 5 is an end elevational view of the remote control receiver shown in FIGS. 3 and 4.
Figure 3:
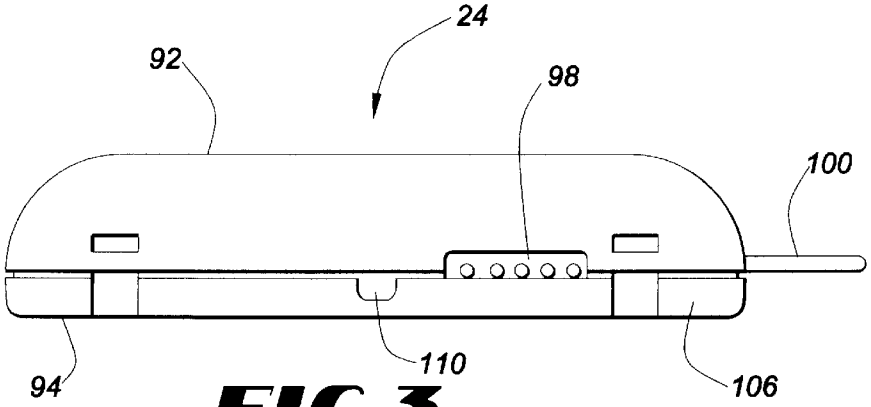
FIG. 3 is a side elevational view illustrating a remote control receiver according to the present invention.
Figure 4:
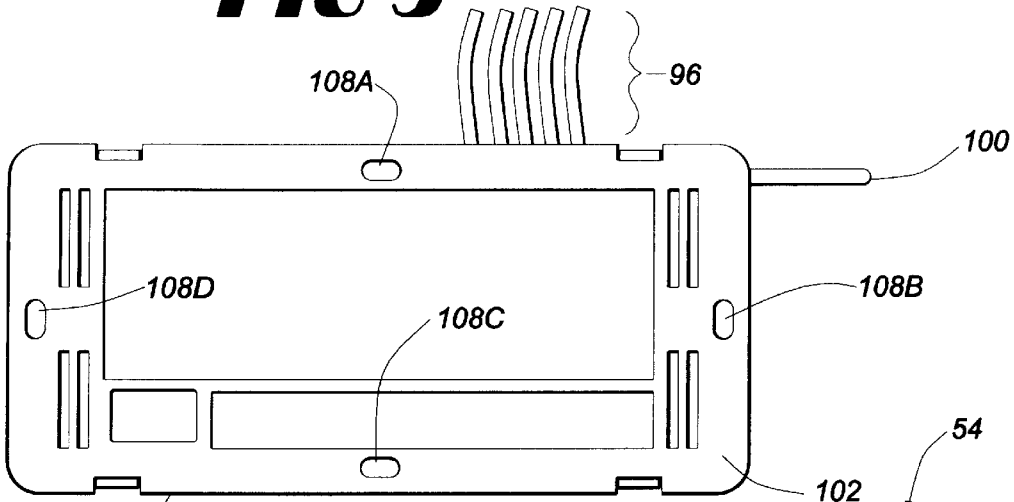
FIG. 4 is a bottom plan view of the remote control receiver shown in FIG. 3.

As shown in FIGS. 3–5 receiver 24 is shaped generally as a parallelepiped, but may comprise a wide variety of other shapes. The lower housing 94 of receiver 24 includes a generally rectangular lower portion 102, a pair of opposing end portions 104 which extend upwardly from lower portion 102, and a pair of opposing side portions 106 which also extend upwardly from the lower portion 102 and interconnect the end portions 104. A plurality of apertures 108 extend through the bottom portion 102 of the lower housing 94. Apertures 108 may comprise generally oval-shaped slots as shown in FIG. 5 but may alternately comprise generally circular through holes or apertures having any other suitable shape. In the illustrative embodiment, receiver 24 includes four of the apertures 108 identified as 108A–108D. Receiver 24 further includes a pair of apertures 110 (one shown), with one of the apertures 110 being formed in each of the side portions 106 of the lower housing 94. Apertures 110 may comprise a generally U-shaped slot, but other suitable shapes may be used. As shown in FIGS. 3 and 4, apertures 110 are longitudinally aligned with apertures 108 so that each of the apertures 110 are disposed in close proximity to one of the apertures 108. For instance, the aperture 110 which is shown in FIG. 3 is disposed in close proximity with aperture 108A formed in the bottom portion 102 of lower housing 94, while the aperture 110 (not shown in FIG. 3) formed in the opposite side portion 106 is disposed in close proximity to aperture 108C.

Receiver 24 further includes a pair of apertures 112 (one shown), with one of the apertures 112 being formed in each of the end portions 104 of the lower housing 94. Apertures 112 may comprise generally U-shaped slots, but apertures 112 may have other suitable shapes. Apertures 112 are laterally aligned with apertures 108 so that each of the apertures 112 is disposed in close proximity to one of the apertures 108. For instance, the aperture 112 which is shown in FIG. 5 is disposed in close proximity to the aperture 108B formed through the lower portion 102 of the lower housing 94, while the aperture 112 (not shown) formed in the opposite end portion 104 is disposed in close proximity to aperture 108D. The alignment of apertures 110 with selected ones of apertures 108 and the alignment of apertures 112 with other apertures 108, as described previously, facilitates a preferred means for mounting receiver 24 to a stationary portion of ceiling fan 10 as subsequently discussed in conjunction with FIG. 6. However, it should be understood that other numbers, relative positioning, and shapes of apertures 108,110, and 112 may be used provided that receiver 24 may be suitably secured to a stationary portion of ceiling fan 10.

Figure 6:
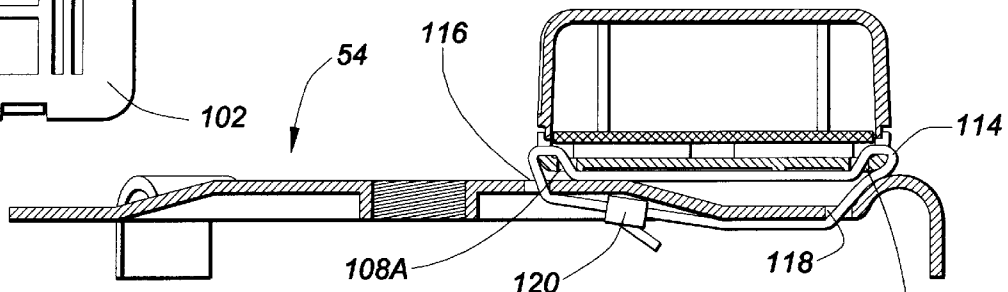
FIG. 6 is an enlarged, cross-sectional view taken along line 6—6 in FIG. 1.

As stated previously, the remote control receiver 24 is disposed within the interior space 26 formed by the motor housing 22, and is secured to a stationary portion of ceiling fan 10 at a position spaced apart from the rotor 42 so as to avoid damage to receiver 24. Receiver 24 may be attached to a stationary portion of fan 10 using at least an opposing pair of the apertures 108 and the corresponding, aligned ones of apertures 110 and 112, as well as at least one strap, or band 114, which is shown in FIGS. 1 and 6. In the illustrative embodiment shown in FIGS. 1–6, receiver 24 is attached to the motor mount plate 54 as follows. The receiver 24 is positioned so that it rests on an upper surface of the motor mount plate 54. Due to the relative sizes of receiver 24 and the motor mount plate 54, the lateral extent or distance between side portions 106 of housing 94, is preferably oriented in a generally radially extending direction. As shown in FIGS. 1 and 6, the strap 114 is looped through each of the apertures 110 as well as apertures 108A and 108C, passes beneath the bottom portion 102 of lower housing 94 and also passes through apertures or holes 116 and 118 formed in motor mount plate 54 so as to complete a loop. The strap 114 may be locked with locking feature 120. The strap or band 114 may be made of any suitable material such as plastic or metal. Furthermore, other means, including cables or wires, may be used in conjunction with apertures 108, 110, and 112 to secure receiver 24 in lieu of the strap or band 114. Antenna 100 of receiver 24 may be secured in any suitable manner to a stationary portion of ceiling fan 10, for instance either to the motor mount plate 54 or ceiling mount plate 12, so that antenna 100 does not become entangled with rotor 42 of motor 14.

Figure 7:
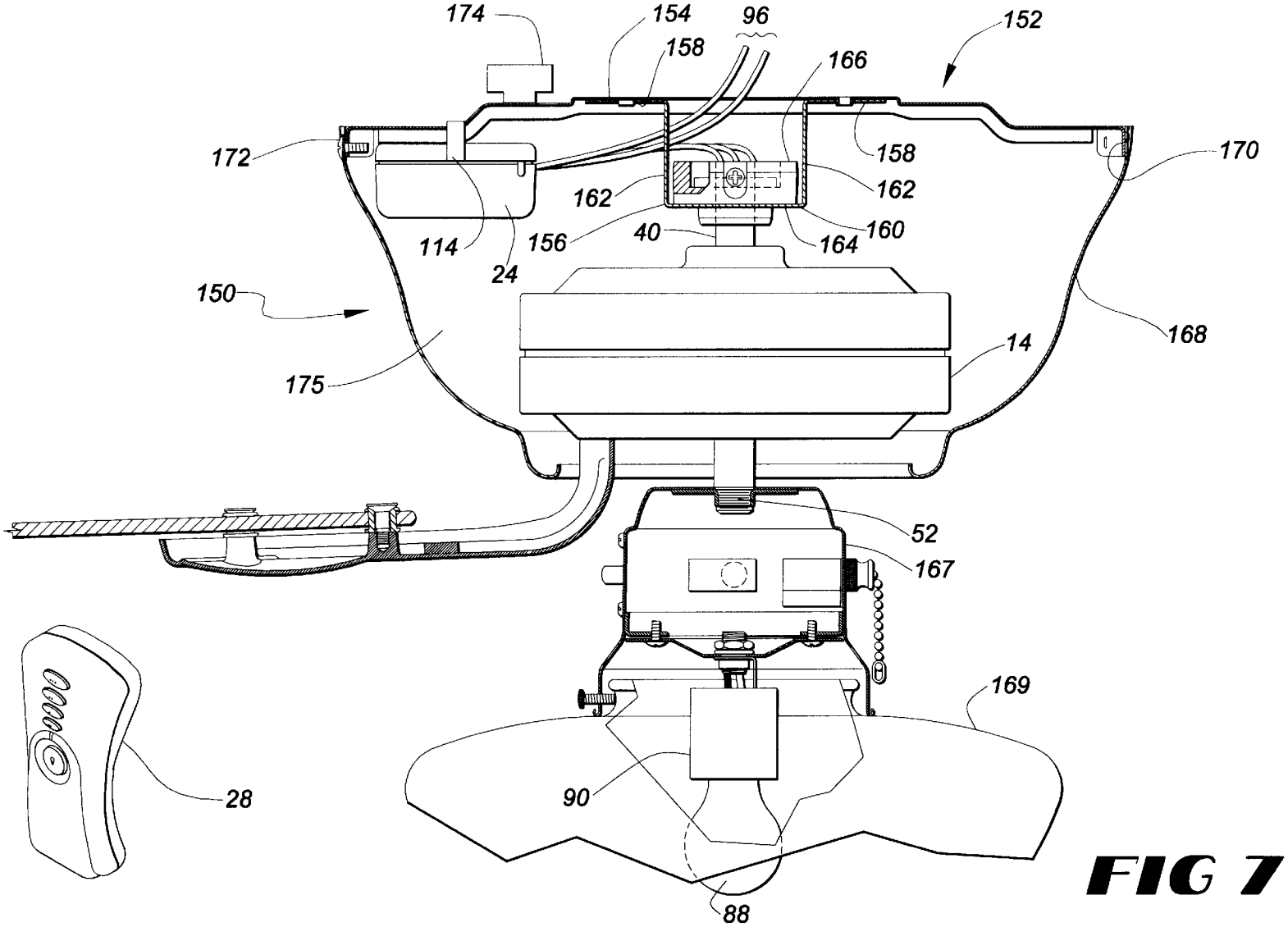
FIG. 7 is a cross-sectional view of a low profile ceiling fan according to a second embodiment of the present invention.

FIG. 7 is a cross-sectional view illustrating a low profile ceiling fan 150 according to a second embodiment of the present invention. The included components and operation of ceiling fan 150 are the same as those discussed previously with respect to ceiling fan 10, except as subsequently noted. Ceiling fan 150 does not include the ceiling mount plate 12, but instead includes a ceiling mount plate 152 having a generally rectangular upper portion 154 and a generally central hat-shaped portion 156 which is attached to a lower surface of the rectangular portion 154. The hat-shaped portion 156 includes a pair of flanges 158, which are disposed in abutting relationship with the lower surface of rectangular portion 154, and a generally central U-shaped portion 160 which is attached to each of the flanges 158.

Unlike ceiling fan 10, ceiling fan 150 does not include the motor mount plate S4, but instead, the motor 14 of ceiling fan 150 is supported by mount plate 152 as follows. The U-shaped portion 160 of mount plate 152 includes apertures (not shown) formed in one of a pair of side walls 162 and a bottom wall 164, for the purpose of accepting the threaded upper end 50 of the stator shaft 40. The stator shaft 40 is retained in place, by a lock nut 166 threaded onto the end 50 of shaft 40. Lock nut 166 engages the upper surface of the bottom wall 164 of portion 160 of mount plate 152.

Ceiling fan 150 includes a motor housing 168 which is similar to, but somewhat different in shape from the motor housing 22 of ceiling fan 10. Motor housing 168 surrounds motor 14 so as to substantially obscure motor 14 from view, and may include a decorative outer surface finish like motor housing 22. Motor housing 168 is attached to opposing outer flange portions 170 of the mount plate 152 by conventional means such as fasteners 172.

A switch housing 167 is threaded onto the lower end 52 of stator shaft 40 of fan 150, in lieu of the switch housing 18 of fan 10. Switch housing 167 is shaped somewhat differently than switch housing 18 but is functionally the same. Also, fan 150 may include an optional light fixture. In the illustrative embodiment, fan 150 includes a light fixture 169, in lieu of light fixture 20 of fan 10. Similar to the light fixture 20,the light fixture 169 includes the light source 88 operatively engaged in the light bulb socket 90 which is supported by the switch housing 167. The a.c. wiring necessary to operate light source 88 is routed through switch housing 167, upward through the hollow interior of shaft 40, and outward through the upper threaded end 50 of shaft 40. The wiring is then electrically connected to receiver 24 which receives radio frequency signals from transmitter 28, in response to input from the operator, to control the operation of light source 88. In an add-on application, the pre-existing light switch and fan speed control switch should be positioned to "on" and "high" respectively, as discussed previously with respect to light fixture 20 of fan 10, to render receiver 24 effective for controlling the operation of light source 88.

Ceiling fan 150 may further include a plurality of resilient spacers 174 (one shown) which are attached to an upper surface of the mount plate 152 and disposed between the ceiling and mount plate 152 for purposes of damping any vibrations induced by the rotation of fan blade 16 and motor 14. Spacers 174 are preferably made of rubber, but may alternatively be made of other resilient materials.

Figure 8:
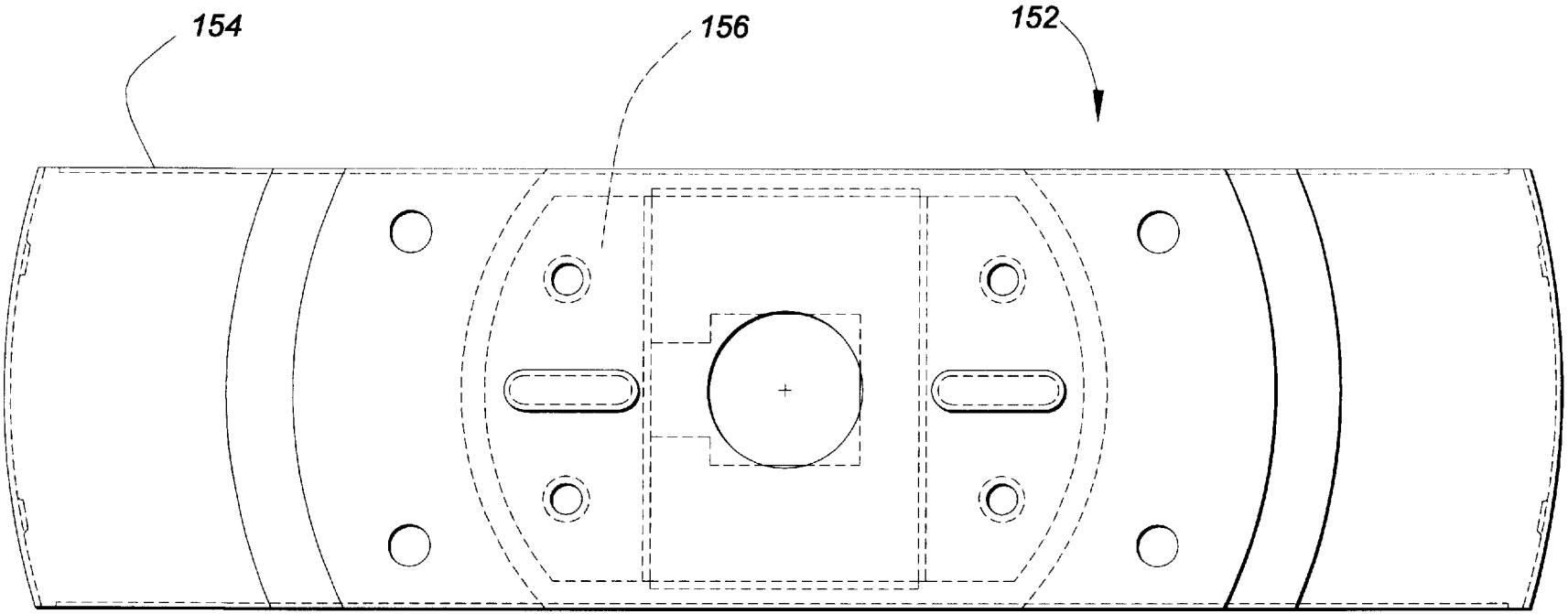
FIG. 8 is a top plan view further illustrating the mount plate shown in FIG. 7.

In this embodiment, the remote control receiver 24 is disposed within an interior space 175 formed by the motor housing 168, and is secured to mount plate 152 at a position spaced apart from the rotor 42. The particular orientation of the remote control receiver 24 within motor housing 168 may vary with application and, more particularly, may vary with the available space between the hat-shaped portion 156 of mount plate 152 and the motor housing 168. In the illustrative embodiment shown in FIGS. 7 and 8, receiver 24 extends substantially transverse to mount plate 152. In other embodiments, which may include increased diameter fan blades 16 and include a larger distance between the hat-shaped portion 156 and motor housing 168, the remote control receiver 24 may be oriented substantially parallel relative to mount plate 152 or at other suitable relative angular orientations.

The particular orientation of receiver 24 will determine the particular ones of apertures 108, 110 and 112 which are used in conjunction with strap 114 to secure receiver 24 to an inner portion of mount plate 152. In the illustrative embodiment, strap 114 passes through aperture 108B and the adjacent one of apertures 112, extends over the outer surface of mount plate 154, passes through aperture 108D and the adjacent one of apertures 112, and is secured by locking feature 120 (not shown in FIG. 7). Alternately, strap 114 may pass through holes (not shown) formed in mount plate 154, in addition to apertures 108B and D and 112. As shown in FIG. 7, a portion of strap 114 is disposed between the ceiling and the upper surface of mount plate 152. Strap 114 does not interfere with the installation of ceiling fan 150 due to the step configuration of mount plate 152 shown in FIG. 7, as well as the presence of spacers 174 which space the upper surface of mount plate 152 apart from the ceiling. However, it should be understood that strap 114 has a relatively small thickness and may be compressed somewhat so that the presence of strap 114 does not interfere with the installation of the fan in those embodiments which do not include spacers 174 and for those ceiling fans which may use a relatively flat ceiling mount plate in lieu of the stepped mount plate 152. The antenna 100 of receiver 24 may be secured to either mount plate 152 or motor housing 168 using conventional attachment means such as a cable clamp (not shown).

Figure 9:
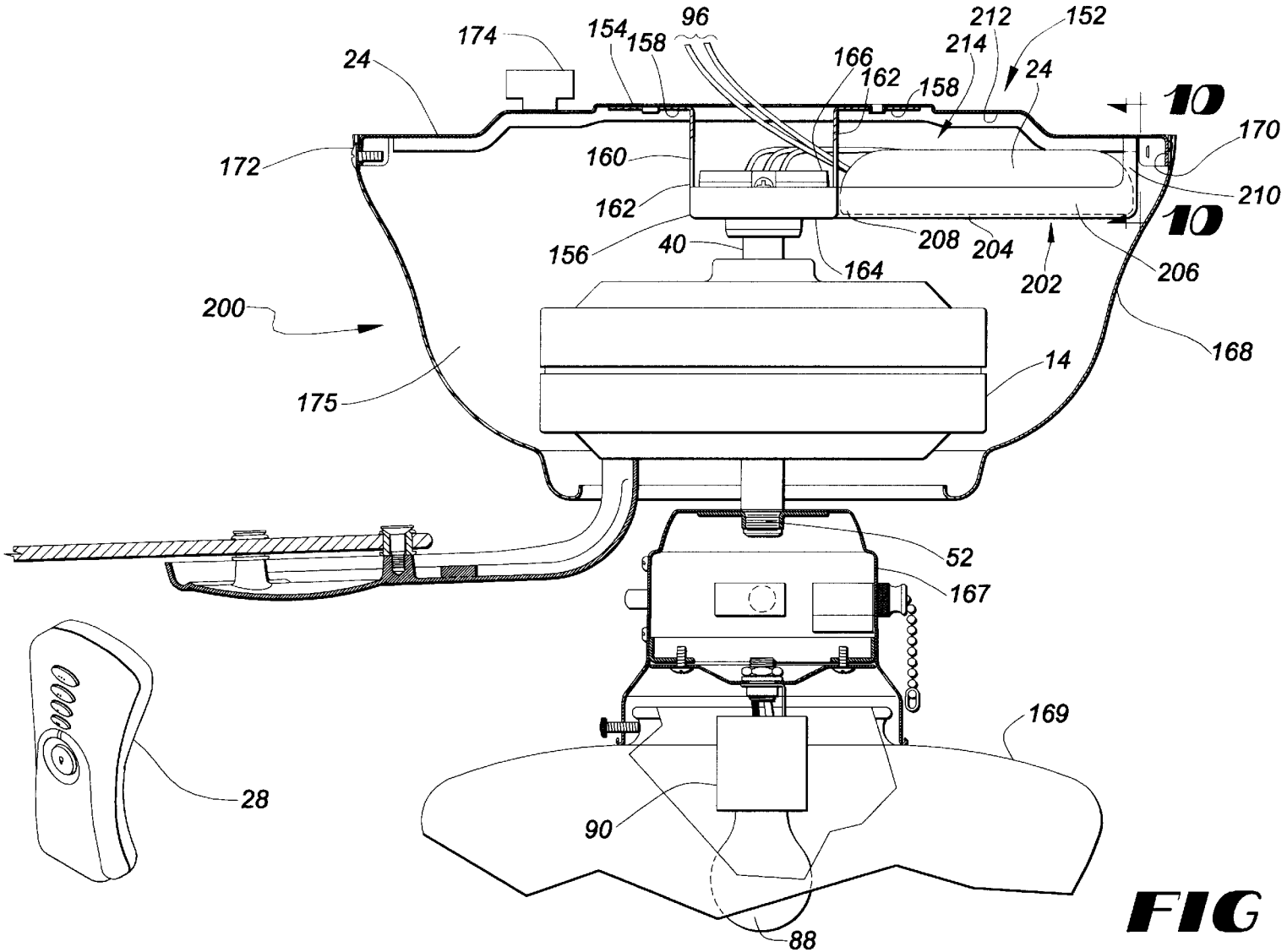
FIG. 9 is a cross-sectional view of a low profile ceiling fan according to a third embodiment of the present invention.
Figure 10:
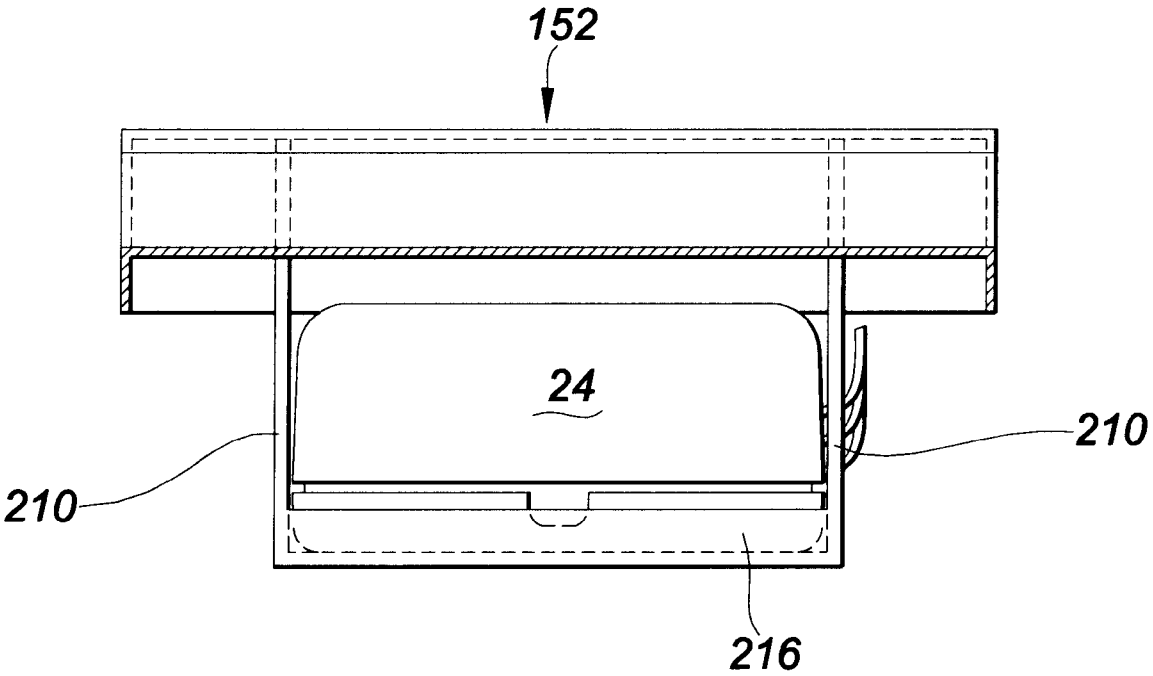
FIG. 10 is an elevational view taken along line 10—10 in FIG. 9.

FIGS. 9 and 10 illustrate a low profile ceiling fan 200 according to a third embodiment of the present invention. The included components and operation of ceiling fan 200 are the same as those discussed previously with respect to ceiling fan 150, except as subsequently noted. The remote control receiver 24 is not attached, or strapped to the ceiling mount plate 152 as discussed previously with respect to ceiling fan 150. Instead, receiver 24 is secured to mount plate 152 via a bracket 202 which is fixedly attached to the ceiling mount plate 152 by conventional means such as welding, brazing or fasteners (not shown). The distance between the hat-shaped portion 156 of mount plate 152 and the motor housing 168 in fan 200 is sufficient to permit the accommodation of bracket 202 and the positioning of receiver 24 as subsequently described. Bracket 202 includes a bottom portion 204, a pair of L-shaped side portions 206 which are spaced apart from one another and extend upwardly from the bottom portion 204. A first end 208 of each side portion 206, as well as the corresponding end of the bottom portion 204 extending therebetween, is attached to the hat-shaped portion 156 of the ceiling mount plate 152 by any suitable conventional means. An opposite end 210 of each side portion 206 is attached to an inner surface 212 of the generally rectangular portion 154 of the ceiling mount plate 152 by any suitable conventional means.

The bracket 202 and the ceiling mount plate 152 define a mount pocket, or space, or receptacle 214 which is suitable for receiving the remote control receiver 24. The remote control receiver 24 is disposed within mount pocket 214 prior to attaching the motor housing 168 to the ceiling mount plate 152. Receiver 24 rests on the upper surface of the bottom portion 204 of bracket 202. The hat-shaped portion 156 of mount plate 152 is open-ended which permits the wires 96 of receiver 24 to be electrically connected to the wires routed upward through shaft 40 of fan 200 and to the a.c. power. Bracket 202 further includes a raised lip 216 which extends upwardly from the bottom portion 202 and between the spaced apart ends 210 of side portions 206, as shown in FIG. 10, for the purpose of retaining the remote control receiver 24 within the mount pocket 214. It should be understood that bracket 202 may assume shapes other than that illustrated provided that bracket 202 and ceiling mount plate 152 define a mount pocket, or space, or receptacle which is suitable for receiving the remote control receiver. It should be further understood that the concept of securing the remote control receiver to a stationary portion of a ceiling fan by disposing receiver 24 in a mount pocket defined by the stationary portion of the ceiling fan and a bracket attached thereto, may be used in conjunction with ceiling fans other than fan 200 and with different stationary portions of the fan provided that receiver 24 is disposed within the interior spaced formed by the motor housing at a position spaced apart from the rotating components of the ceiling fan motor. For instance, the foregoing concept of disposing receiver 24 within a mount pocket may be used in conjunction with ceiling fan 10.

In operation, the remote control receiver 24 of the ceiling fans 10, 150 or 200 receives radio signals from remote control transmitter 28 for the purpose of controlling the speed of rotation of rotor 42 and fan blades 16. In certain applications receiver 24 may also control the direction of rotation of rotor 42 and fan blades 16. Additionally, the remote control receiver 24 may be used to control the operation of the light sources in the optional light fixture 20 of ceiling fan 10 or the optional light fixture 169 of ceiling fans 150 and 200. In each embodiment, receiver 24 is disposed within the interior space formed by the motor housing at a position spaced apart from the rotating components of the inside-out motor 14, and secured to a stationary portion of the corresponding one of ceiling fans 10, 150, and 200. In each embodiment, receiver 24 is secured in a simple and economical manner. In the two embodiments corresponding to fans 10 and 150, receiver 24 is secured to a stationary portion of the corresponding ceiling fan using straps, bands, cables, wires or other equivalent means of attachment in conjunction with the plurality of apertures formed in the remote control receiver 24 and holes formed in the associated structure of ceiling fans 10, and 150. With respect to ceiling fan 200, receiver 24 is economically secured by disposing receiver 24 within the mount pocket 24 formed by bracket 202 and the ceiling mount plate 152. The present invention permits a ceiling fan user to enjoy the convenience of remote control operation in conjunction with a low profile ceiling fan which was presently unavailable and permits a non-remote-controlled low profile ceiling fan to be converted to one permitting remote control.

While the foregoing description has set forth the preferred embodiments of the present invention in particular detail, it must be understood that numerous modifications, substitutions and changes can be undertaken without departing from the true spirit and scope of the present invention as defined by the ensuing claims. For instance, receiver 24 may be secured to a stationary portion of a ceiling fan by means other than apertures 108, 110 and 112 and the associated straps, bands, cables, wires, etc. or mount bracket 202 and the associated mount pocket 214. These alternative means (not shown) may include the use of magnets, Velcro, adhesive or other equivalent means. Additionally, while receiver 24 is secured to either motor mount plate 54 or ceiling mount plate 152 in the three specific embodiments of ceiling fans which are illustrated, receiver 24 may alternatively be secured to other stationary portions of a ceiling fan, such as the motor housing, provided that the receiver 24 is spaced apart from the rotor 42 of motor 14 to avoid damage to receiver 24. Furthermore, while the remote control receiver 24 has been illustrated for use with ceiling fans having inside-out motors, receiver 24 may be incorporated in ceiling fans having motors in which the stator surrounds the rotor and the rotor rotates within the stator. The invention is therefore not limited to specific preferred embodiments as described, but is only limited as defined by the following claims.

What is claimed is:

1. A remote control receiver for use in a ceiling fan having a motor, said remote control receiver comprising:

an upper housing;

a lower housing engaged with said upper housing, said upper and lower housings combining to form an interior space, said lower housing including a lower portion, a pair of opposing end portions extending upwardly from said lower portion and a pair of opposing side portions extending upwardly from said lower portion;

attachment means for attaching said remote control receiver to a stationary portion of the ceiling fan at a position spaced apart from a rotating portion of the ceiling fan motor;

said remote control receiver being in electrical communication with the motor and operably effective for controlling a least a speed of rotation of the motor when installed in the ceiling fan;

said attachment means comprises a first plurality of apertures formed in and extending through said lower portion of said lower housing and a second plurality of apertures formed in and extending through said lower housing at a position spaced above said lower portion, each of said second plurality of apertures being aligned with and in communication with one of said first plurality of apertures.

2. The remote control receiver as recited in claim 1, wherein:

said first plurality of apertures is spaced apart from a periphery of said lower portion.

3. The remote control receiver as recited in claim 1, wherein:

said remote control receiver further comprises electronic circuitry means for controlling at least the speed of rotation of the motor of ceiling fan, said electronic circuitry means disposed at least in part within said interior space;

said upper housing includes an opening formed therein;

said electronic circuitry means terminates in a plurality of wires which exit said upper housing through said opening.

4. The remote control receiver as recited in claim 1, wherein:

each of said first plurality of apertures and each of said second plurality of apertures communicates with said interior space defined by said upper and lower housings.

5. The remote control receiver as recited in claim 4, wherein:

each of said second plurality of apertures is formed in and extends through one of said end portions of said lower housing and is disposed proximate one of said first plurality of apertures formed in said lower portion, each of said end portions of said lower housing including at least one of said second plurality of apertures.

6. The remote control receiver as recited in claim 5, wherein:

said means for attaching further comprises a third plurality of apertures, each of said third plurality of apertures being formed in and extending through one of said side portions of said lower housing and disposed proximate one of said first plurality of apertures formed in said lower portion, each of said third plurality of apertures being aligned with and in communication with one of said first plurality of apertures via said interior space formed by said lower housing and said upper housing, each of said side portions of said lower housing including at least one of said third plurality of apertures.

7. A remote control receiver for use in a ceiling fan having a motor, said remote control receiver comprising:

an upper housing;

a lower housing engaged with said upper housing, said upper and lower housings combining to form an interior space, said lower housing including a lower portion, a pair of opposing end portions extending upwardly from said lower portion and a pair of opposing side portions extending upwardly from said lower portion;

a first plurality of apertures formed in and extending through said lower portion;

a second plurality of apertures, each of said second plurality of apertures formed in and extending through one of said end portions of said lower housing and disposed proximate one of said first plurality of apertures;

a third plurality of apertures, each of said third plurality of apertures formed in and extending through one of said side portions and disposed proximate one of said first plurality of apertures;

said remote control receiver being attachable to the ceiling fan using selected ones of said first, second and third pluralities of apertures, each of said second plurality of apertures being aligned with one of said first plurality of apertures and communicating with the corresponding one of said first plurality of apertures via said interior space, each of said third plurality of apertures being aligned with one of said first plurality of apertures and communicating with the corresponding one of said first plurality of apertures via said interior space;

said remote control receiver being in electrical communication with said motor and effective for controlling at least a speed of rotation of said motor when installing said ceiling fan.

8. A system for installing a remote control receiver in a ceiling fan having a motor with a rotor and a stator, the ceiling fan further including a motor housing surrounding the motor, the remote control receiver including upper and lower housings which engage one another, said system comprising;

a plurality of apertures formed in at least one of the upper and lower housings of said remote control receiver;

at least one strap looped through selected ones of said apertures to secure the remote control receiver within the motor housing at a location spaced apart from the rotor of the ceiling fan motor.

9. The system as recited in claim 8, further comprising:

a stationary portion of the ceiling fan disposed within the motor housing;

said at least one strap being effective for securing said remote control receiver to said stationary portion at a location spaced apart from the rotor.

10. The system as recited in claim 9, wherein:

said stationary portion comprises a ceiling mount plate effective for attaching the ceiling fan to a ceiling;

said remote control receiver is disposed proximate a first side of said ceiling mount plate;

said at least one strap extends across an opposite side of said ceiling mount plate.

11. The system as recited in claim 8, wherein:

said lower housing of said remote control receiver comprises a lower portion, a pair of opposing end portions extending upwardly from said lower portion and a pair of opposing side portions extending upwardly from said lower portion and interconnecting said end portions;

said plurality of apertures comprises a first plurality of apertures formed in and extending through said lower portion.

12. The system as recited in claim 11, further comprising:

a second plurality of apertures, each of said second plurality of apertures formed in and extending through one of said opposing end portions and disposed proximate one of said first plurality of apertures.

13. The system as recited in claim 12, further comprising:

a third plurality of apertures, each of said third plurality of apertures being formed in and extending through one of said side portions and disposed proximate one of said first plurality of apertures.

14. A system for installing a remote control receiver in a ceiling fan having a motor with a rotor and a stator, the ceiling fan further including a motor housing surrounding the motor the remote control receiver including upper and lower housings which engage one another, said system comprising:

a plurality of apertures formed in a least one of the upper and lower housings of said remote control receiver;

at least one strap passed through selected ones of said apertures to secure the remote control receiver within the motor housing at a location spaced apart from the rotor of the ceiling fan motor; and a stationary portion of the ceiling fan disposed within the motor housing; wherein said at least one strap being effective for securing said remote control receiver to said stationary portion at a location spaced apart from the rotor;

said stationary portion comprises a motor mount plate attached to the stator of the ceiling fan motor;

said system further comprises a plurality of apertures formed in said motor mount plate;

said at least one strap engages said apertures in said motor mount plate.

15. A kit of component parts for a ceiling fan comprising:

a remote control receiver having upper and lower housings which engage one another and combine to form an interior space, said lower housing including a plurality of apertures formed therein;

at least one strap sized for engagement with said apertures;

at least one of a motor mount plate and a ceiling mount plate;

said lower housing of said remote control receiver includes a lower portion, a pair of opposing end portions extending upwardly from said lower portion and a pair of opposing side portions extending upwardly from said lower portion and interconnecting said end portions;

said plurality of apertures comprises first, second and third pluralites of apertures, said first plurality of apertures being formed in and extending through said lower portion, each of said second plurality of apertures being formed in and extending through one of said end portions and disposed proximate one of said first plurality of apertures and communicating with the corresponding proximate one of said first plurality of apertures via said interior space, whereby each of said second plurality of apertures and the corresponding proximate one of said first plurality of apertures are operably effective for receiving one of said at least one strap, each of said third plurality of apertures being formed in and extending through one of said side portions and disposed proximate one of said first plurality of apertures and communicating with the corresponding proximate one of said first plurality of apertures via said interior space whereby each of said third plurality of apertures and the corresponding proximate one of said first plurality of apertures are operably effective for receiving one of said at least one strap.

16. A ceiling fan comprising:

a motor having a rotor and a stator;

a plurality of fan blades attached to said rotor;

a motor housing disposed in surrounding relationship with said motor, said motor housing defining an interior space; and a remote control receiver in electrical communication with said motor, said remote control receiver effective for controlling at least the rotational speed of said motor, said remote control receiver being disposed within said interior space in a location spaced apart from the rotor, said remote control receiver being secured to a stationary portion of said ceiling fan; wherein said stationary portion comprises a motor mount plate which supports said motor;

said remote control receiver comprises an upper housing and a lower housing engaged with one another, and a plurality of apertures formed in at least one of said upper and lower housings;

said motor mount plate includes a plurality of openings;

said ceiling fan further comprises a strap having a first end and a second end, said strap being passed through selected ones of said apertures in said remote control receiver and through selected openings in said motor mount plate, said first end of said strap being fastened to said second end to form a loop to secure the remote control receiver to the motor mount plate.

17. The ceiling fan as recited in claim 16, wherein said motor is an inside-out motor, said rotor being rotatable about said stator.

18. A ceiling fan comprising:

a motor having a rotor and a stator;

a plurality of fan blades attached to said rotor;

a motor housing disposed in surrounding relationship with said motor, said motor housing defining an interior space; and a remote control receiver in electrical communication with said motor, said remote control receiver effective for controlling at least the rotational speed of said motor, said remote control receiver being disposed within said interior space in a location spaced apart from the rotor, said remote control receiver being secured to a stationary portion of said ceiling fan;

a ceiling mount plate for securing the ceiling fan to a ceiling; wherein said stationary portion comprises said ceiling mount plate;

said remote control receiver includes a plurality of apertures;

said ceiling fan further comprises a strap having a first end and a second end, said strap being passed through selected ones of said apertures and over one side of said ceiling mount plate, said first end of said strap being fastened to said second end to form a loop to secure the remote control receiver to the opposite side of said ceiling mount plate.

19. A ceiling fan comprising:

a motor having a rotor and a stator;

a plurality of fan blades attached to said rotor;

a motor housing disposed in surrounding relationship with said motor, said motor housing defining an interior space;

a remote control receiver in electrical communication with said motor, said remote control receiver being effective for controlling at least the rotational speed of said motor, said remote control receiver being disposed within said interior space in a location spaced apart from the rotor;

a bracket attached to a stationary portion of said ceiling fan; and a mount pocket defined by said bracket and said stationary portion;

wherein said remote control receiver is disposed within said mount pocket.

20. The ceiling fan as recited in claim 19, wherein:

said stationary portion comprises said ceiling mount plate;

said mount pocket is defined by said bracket and said ceiling mount plate.

21. The ceiling fan as recited in claim 20, wherein:

said bracket includes a bottom portion and a pair of side portions attached to and extending upwardly from said bottom portion, said side portions being attached to said ceiling mount plate;

said remote control receiver is positioned on said bottom portion.

22. A low profile ceiling fan comprising:

an inside-out motor having a rotor and a stator, said rotor being rotatable about said stator;

a plurality of fan blades attached to said rotor;

a motor housing disposed in surrounding relationship with said motor, said motor housing defining an interior space;

a remote control receiver in electrical communication with said motor, said remote control receiver effective for controlling at least the rotational speed of said motor, said remote control receiver being disposed within said interior space in a location spaced apart from the rotor; and a strap having a first end and a second end;

said remote control receiver comprising an upper housing and a lower housing engaged with one another, said remote control receiver further including a plurality of apertures formed in said lower housing;

said strap being passed through selected ones of said apertures in said remote control receiver and over at least one side of said stationary portion, said first end being fastened to said second end to form a loop to secure said remote control receiver to said stationary portion.

23. The low profile ceiling fan as recited in claim 22, further comprising:

a switch housing disposed and supported below said motor, and a light fixture supported by said switch housing, said light fixture having a light source in electrical communication with said remote control receiver;

wherein said remote control receiver is effective for controlling said light source.

24. A low profile ceiling fan for installation on a ceiling, said ceiling fan comprising:

a ceiling mount plate for securing the ceiling fan to the ceiling;

an inside-out motor disposed below and supported by said ceiling mount plate, said motor having a rotor and a stator, said rotor being rotatable about said stator;

a plurality of fan blades attached to said rotor of said motor for rotation therewith during operation of the motor;

a motor housing attached to said ceiling mount plate and disposed in surrounding relationship with said motor, said motor housing defining an interior space;

a remote control receiver in electrical communication with said motor, said remote control receiver being effective for controlling at least the rotational speed of said motor and said fan blades, said remote control receiver being disposed within said motor housing, said remote control receiver comprising a plurality of apertures; and a strap having a first end and a second end, said strap being passed through selected ones of said apertures in said remote control receiver, said first end of said strap being fastened to said second end to form a loop to secure the remote control receiver to a stationary portion of said ceiling fan.

* * * * *